United States Patent [19]

Selkee

[11] Patent Number: 4,629,184

[45] Date of Patent: Dec. 16, 1986

[54] EXERCISE APPARATUS EMPLOYED FOR PERFORMING TWO HANDED CURLING EXERCISES

[76] Inventor: Thomas V. Selkee, 2583 N. Sweetbriar Dr., Claremont, Calif. 91711

[21] Appl. No.: 801,840

[22] Filed: Nov. 26, 1985

[51] Int. Cl.[4] ..... A63B 13/00

[52] U.S. Cl. ..... 272/123; D21/197; 272/143

[58] Field of Search ..... 272/93, 122, 123, 143; D21/196–198

[56] References Cited

U.S. PATENT DOCUMENTS

| | | | |
|---|---|---|---|
| 1,333,005 | 3/1920 | Warner | 272/143 X |
| 3,370,850 | 2/1968 | Moore | 272/123 X |
| 3,384,370 | 5/1968 | Bailey et al. | 272/123 |
| 4,461,473 | 7/1984 | Cole | 272/123 |

*Primary Examiner*—Richard J. Apley
*Assistant Examiner*—John Welsh

[57] ABSTRACT

A weightlifting apparatus for performing two handed curling exercises which provides for multi-axes wrist and hand rotation. The weightlifting apparatus includes a frame having outer ends thereof adapted to have weights mounted thereon. A pair of spaced apart, generally U-shaped members, are rotatably supported within the frame by thrust and radial bearings. A handle member consisting of an outer frame portion with a cross member rigidly fastened between opposite sides of the outer frame is rotatably supported within each U-shaped member by a pair of bearings disposed between end portions of each U-shaped member. The distance between the handle members is adjustable.

9 Claims, 6 Drawing Figures

EXERCISE APPARATUS EMPLOYED FOR PERFORMING TWO HANDED CURLING EXERCISES

1. TECHNICAL FIELD

The present invention relates to exercise apparatus employed for performing two handed curling exercises.

2. BACKGROUND

In the art of weight training, curling exercises to develop the human biceps are performed by grasping a weighted bar with one or two hands and curling the forearm upwards and back toward the upper arms.

Biceps development can be further increased by supinating the hands while curling. Supination consists of starting with a palms down position at the beginning of the curling exercise and rotating the hands to a palms up position while performing the curling exercise. Weight trainers currently use dumbells for supination type curling exercises since they allow multi-axes hand movement so the weight trainer may select hand and wrist motions which maximize muscle growth. Dumbells are slow to use and they throw the weight trainer off balance compared to a two handed curling bar. A two handed curling bar allows the weight trainer to lift heavier weights without encountering balancing problems.

Various types of weightlifting apparatus have been proposed to allow two handed curling exercises with supination. The Bailey et al weightlifting apparatus, disclosed in U.S. Pat. No. 3,384,370 utilizes a pair of rotatably mounted handles in spaced apart rings. The rings are fastened together by a straight rod. On the outside extremity of each ring is fastened a straight rod for placement of weights. The Bailey weightlifting apparatus allows single axis wrist rotation during curling exercises.

The Cole weightlifting apparatus, U.S. Pat. No. 4,461,473 provides the same function as the Bailey weightlifting apparatus but its improvements include a novel frame, a spring interconnecting the handles which supplies a biasing force that resists rotation of the handles and a method to synchronize the rotation between the two handles.

Both the Cole and Bailey weight lifting apparatus have shortcomings which have slowed their acceptance by weight trainers. They both allow rotation of wrists and hands only about one axis. The weight trainer, when curling, must bend his wrists during wrist rotation about a single axis. This causes wrist strain. Since both weightlifting apparatus allow constrained wrist rotation about a single axis, they do not provide hand motion similar to that obtained by using dumbells which allow the weight trainer to select movements that maximize muscle growth.

Both the Cole and Bailey weightlifting apparatus use multiple sets of roller bearings to support the handles and provide a means for handle rotation. The roller bearing systems are not designed for thrust loads and thus higher friction is imparted to handle rotation when thrust loads are developed while curling.

The roller bearings ride on exposed bearing surfaces which are constantly subject to contamination by foreign particulate matter. As the bearing surfaces become contaminated, a discontinuous, jerky rotational motion is imparted to the handles as the cam bearings ride over the particulate matter.

The Cole and Bailey weightlifting apparatus also lack a means for adjusting the distance between the two rotatable handle members to compensate for the varied grip lengths used by weight trainers.

It is therefore a primary object of the invention to provide a weightlifting apparatus which overcomes each of the deficiencies discussed above.

A further object of the invention is to present a weightlifting apparatus which provides a means for multiple axis wrist and hand rotation to reduce wrist strain and allow multi-axes two handed curling motion similar to that obtained when using dumbells so each weight trainer can choose wrist and hand movements which maximize muscle growth.

Another object of the invention is to provide a weightlifting apparatus with an enclosed and preloaded antifriction bearing system for smooth, continuous wrist rotation, that mounts to the weightlifting apparatus frame at a single location.

A further object of the invention is to provide a weightlifting apparatus with a means to adjust the distance between the two handles to accommodate the needs of each individual user.

SUMMARY OF INVENTION

A weightlifting apparatus according to one embodiment of the present invention, includes a generally U-shaped frame having outer ends thereof adapted to have weights mounted thereon. The U-shaped frame includes a pair of generally L-shaped members disposed in side by side relationship and adjustably attached together at their inside ends by a structural member. A generally U-shaped member is rotatably supported within each C-shaped member by thrust bearings and a radial bearing. A handle member is disposed between the end portions of each U-shaped member and is rotatably supported by a pair of bearings disposed at the opposite ends of each handle member. The handle member consists of an outer frame and a cross member fastened to the opposite sides of the frame portion.

BRIEF DESCRIPTION OF THE DRAWINGS

Referring now to the drawings which show examples of apparatus in accordance with the present invention used in the description of method in accordance with the present invention:

FIG. 3. is a perspective view of the weightlifting apparatus;

DETAILED DESCRIPTION

Figure 1:
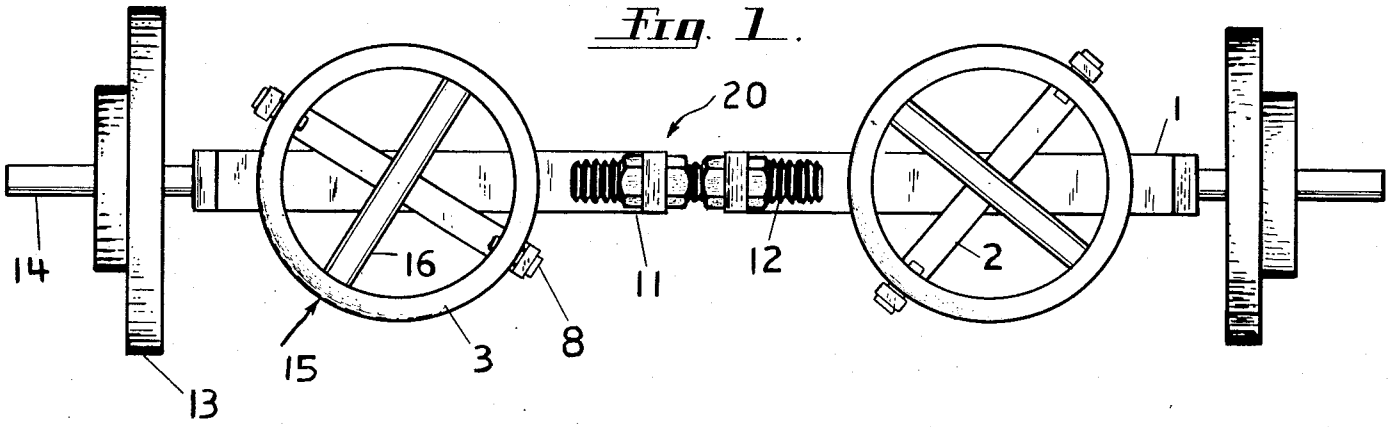
FIG. 1. is a front elevation view of the weightlifting apparatus.
Figure 2:
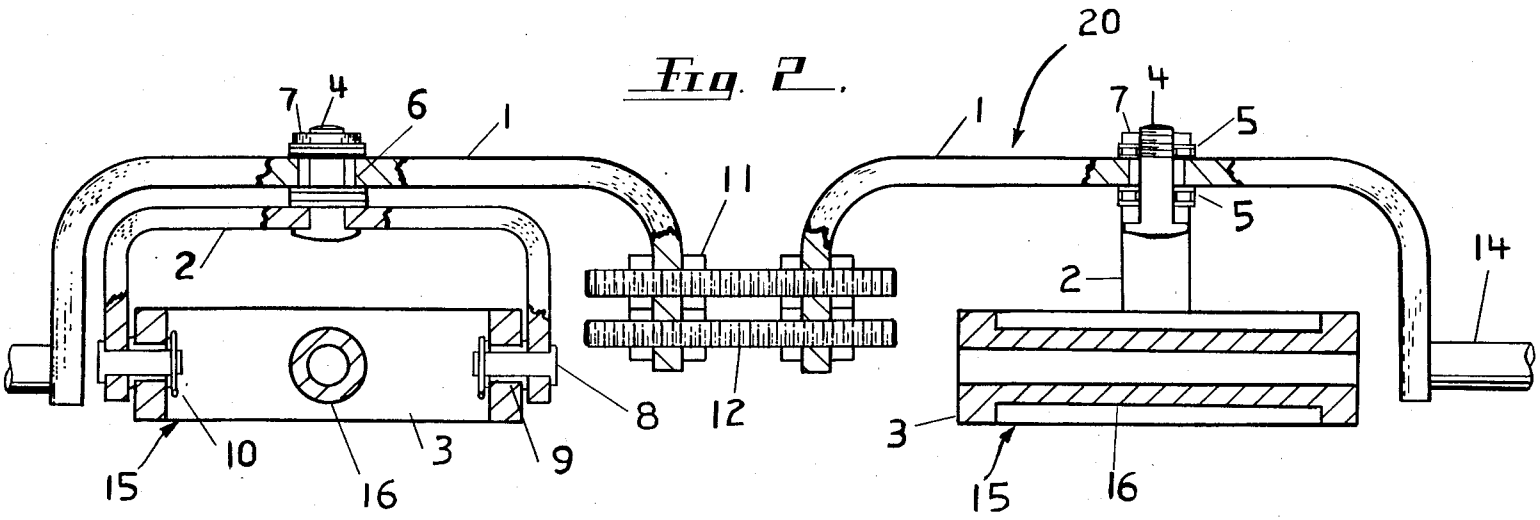
FIG. 2. is a fragmentary, top view of the weightlifting apparatus, parts being broken in section for clarity.
Figure 7:
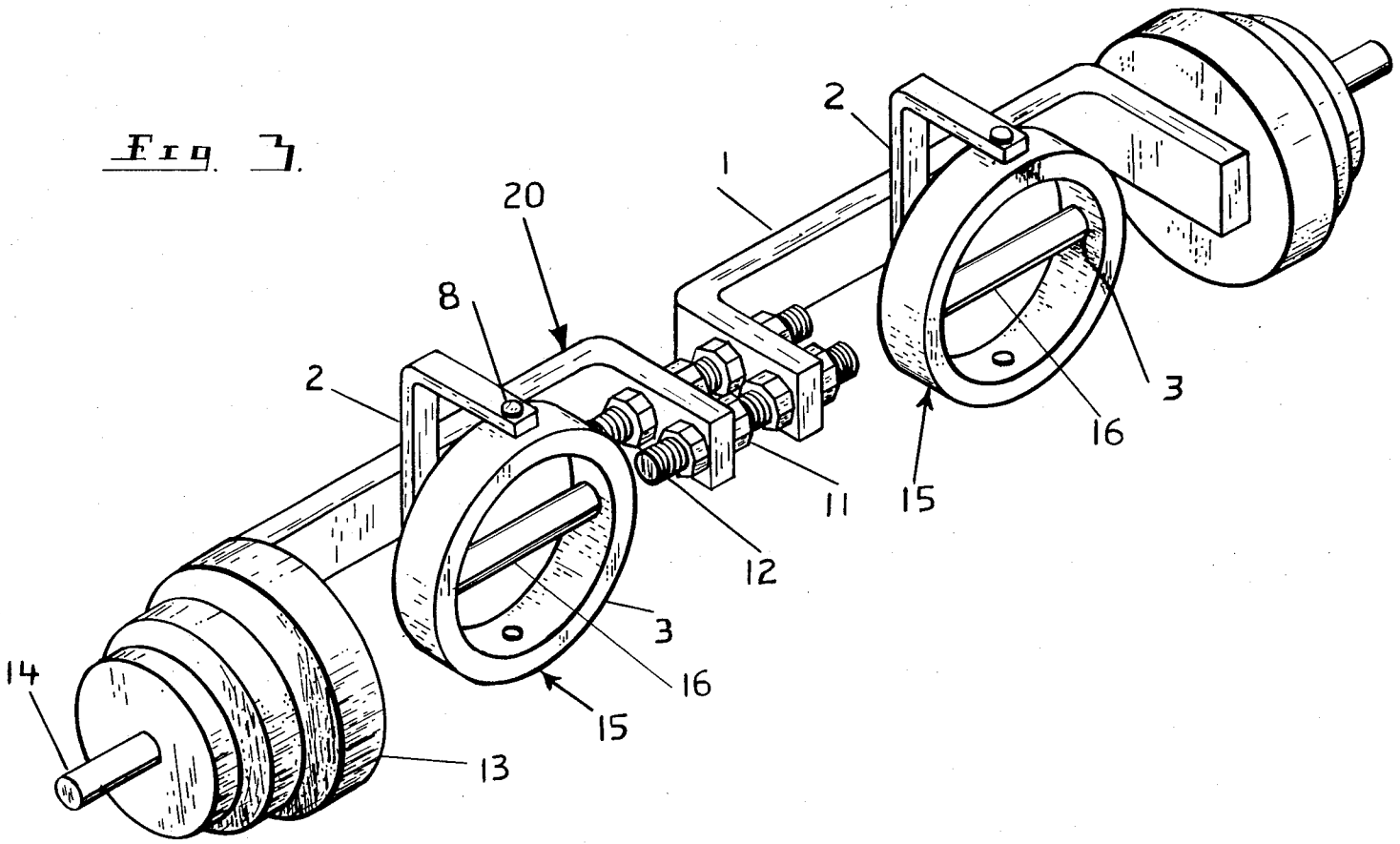

More specifically referring to FIGS. 1-3 the weightlifting apparatus includes a frame indicated generally at 20.

The frame 20 has a pair of outer ends 14 at its outer extremities for attachment and removal of weights 13.

The outer ends may be welded to, mechanically fastened, or an integral formed part of the frame 20.

One embodiment of the frame 20 includes two generally U-shaped members 1 adjustably attached together by two parallel threaded rods 12. Each threaded rod 12 is secured to the inside end of each U-shaped member 1 by a pair of nuts 11.

Figure 4:
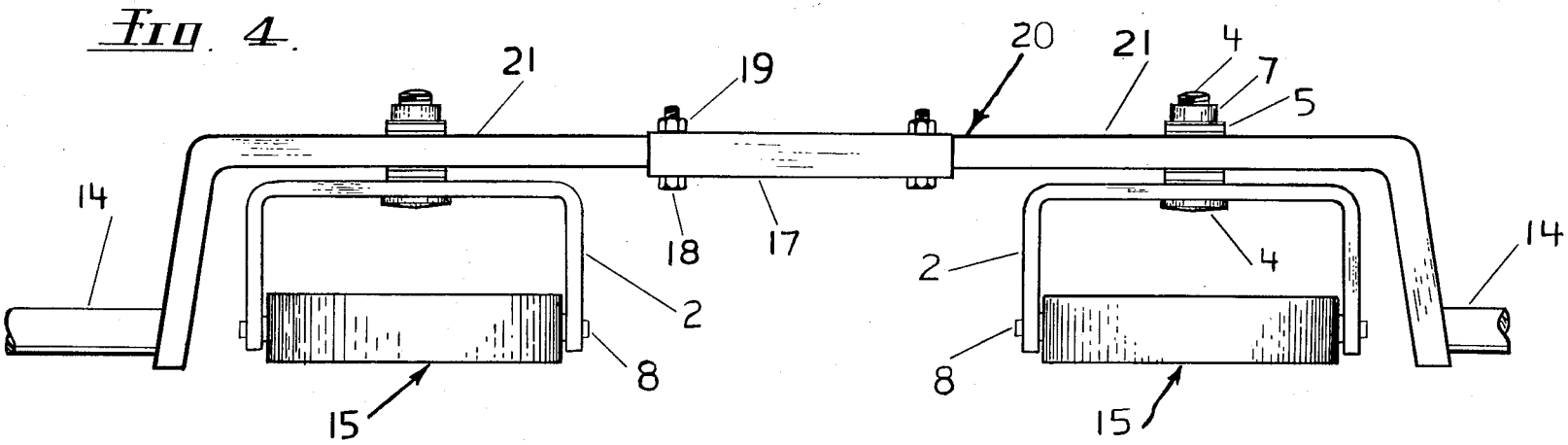
FIG. 4. is a top view of an alternate embodiment of the weightlifting apparatus.
Figure 6:
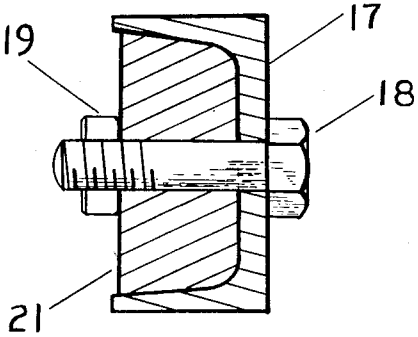
FIG. 6 is a sectional view taken along line 6—6 in FIG. 5.
Figure 5:
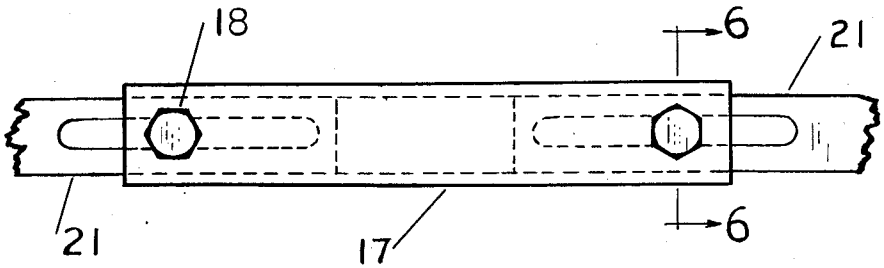
FIG. 5. is a fragmentary, front elevation view of an alternate embodiment of the weightlifting apparatus shown in FIG. 4.

References now made to FIGS. 4–6 where an alternate form of frame construction is depicted. The frame 20 may also consist of two generally L-shaped members 21 adjustably attached together at their inner ends by a structural member 17 which is fastened to each L-shaped member 21 by a bolt 18 and a nut 19.

It will be recognized that the frame 20 can also be generally U-shaped, one piece construction which does not permit adjustment of the distance between the handle members indicated generally by 15. This type of frame can be manufactured more economically for commercial use where many weight lifting apparatus, each with different distances between the handle members 15 may be provided for the weight trainer. The frame 20 should be made from a light weight material like aluminum, magnesium or a glass reinforced structural plastic to make the weightlifting apparatus easy to balance. The frame 20 may be manufactured by injection molding, casting or press forming methods, with casting being the preferred method.

A pair of spaced apart, generally U-shaped members 2 are rotatably mounted to the frame 20 by a shoulder bolt 4 and a shoulder bolt nut 7. Between the frame 20 and each U-shaped member 2 and between the shoulder bolt nut 7 and the frame 20 are thrust bearings 5. Needle thrust bearings take up less space and have lower dynamic coefficients of friction than ball or washer type thrust bearings, thus needle type thrust bearings are preferred. The shoulder bolt 4 is radially supported by a radial bearing 6. The radial bearing 6 may be either ball, needle, bushing or other suitable type designed for radial loading. The U-shaped member rotatably supports the handle member, indicated generally by 15, at two bearing points so located at the inside opposite ends of each U-shaped member 2 so as to form an axis which bisects the handle member 15.

The handle member 15 consists of an outer frame 3 and a cross member 16 between opposite sides of the outer frame 3. The outer frame 3 can be a multitude of geometric shapes, the circle being preferred. The handle member 15 may be of one piece construction, using injection molding, casting or other suitable manufacturing means. The handle member can be also made using multiple part construction methods where the cross member 16 is attached to the outer frame 3 by a suitable fastening means. The handle member 15 is rotatably mounted to the U-shaped member 2 by a pair of clevis type pins 8 which fit inside a pair of thrust bearings 9. Each clevis type pin is secured in place by a retaining ring 10.

It will be recognized that the foregoing is but one example of an apparatus and method within the scope of the present invention and that various other modifications will occur to those skilled in the art upon reading the disclosure set forth hereinbefore.

I claim:

1. Weightlifting apparatus comprising:

a rigid frame means having a pair of outer ends with means thereon to removably support weights, a pair of generally U-shaped members, each having a pair of end portions connected by a bight portion. The U-shaped members being axially spaced apart and rotatably mounted between the outer ends of said frame means at said bight portions, elongate handle member disposed between the end portions of each said U-shaped member, wherein the longitudinal axis of each said handle member transverses the bight portion of said U-shaped member, and means for rotatably mounting said handle members between the end portions of each of said U-shaped member, whereby said handle members rotate about vertical axes while said U-shaped members provide multi-axes hand movements.

2. The weightlifting apparatus of claim 1, wherein said U-shaped member is rotatably mounted to said frame means by a combination of at least one radial bearing and at least one thrust bearing.

3. The weightlifting apparatus of claim 1, wherein said frame mean comprises:

a pair of generally L-shaped members each having end portions and being disposed in general side by side relationship with the adjacent inner end portions of said L-shaped members spaced apart, means for rigidly connecting the adjacent portions of said L-shaped members together including means for adjusting the spacing between the said adjacent portions.

4. The weightlifting apparatus of claim 3 wherein the said pair of L-shaped members are adjustably attached together at said adjacent inside end portions by a structural member rigidly fastened to each L-shaped member.

5. The weightlifting apparatus of claim 1, wherein said frame means comprises:

a first pair of generally U-shaped members each having a bight portion and end portions and being disposed in general side by side relationship with the adjacent end portions of said members spaced apart, releasable means for rigidly connecting the adjacent end portions of said U-shaped members together including means for adjusting the spacing between said adjacent portions.

6. The weightlifting apparatus of claim 5, wherein said first pair of said generally U-shaped members are adjustably attached together at said adjacent end portions by at least one threaded rod, each threaded rod being secured to the end portion of each said first pair of U-shaped members by a pair of nuts.

7. The apparatus of claim 1, wherein each said handle member comprises an outer frame portion and a cross member disposed between the opposite sides of said frame portion and rigidly secured to said frame portion.

8. The apparatus of claim 7, wherein said outer frame portion is circular in shape.

9. Weightlifting apparatus comprising:

a rigid frame means having a pair of outer ends with means extending laterally from the outer end portion to removably support weights, said frame means comprising a first pair of generally U-shaped members each having a bight portion and end portions and being disposed in general side by side relationship with the adjacent end portions of said members spaced apart, releasable means for rigidly connecting the adjacent end portions of said U-shaped members together including means for adjusting the spacing between said adjacent portions, a second pair of generally U-shaped members, each having a pair of end portions connected by a bight portion, the U-shaped members being axially spaced apart and rotatably mounted by a combination of at least one radial bearing and at least on thrust bearing to said frame means, elongated handle members disposed between the end portions of each said U-shaped member, wherein the longitudinal axis of each said handle member transverses the bight portion of said U-shaped member, and means for rotatably mounting said handle members between the end portions of each of said U-shaped member, whereby said handle members rotate about vertical axes while said U-shaped members rotate about horizontal axes to provide mult-axes hand movements.

* * * * *